US006612383B2

(12) United States Patent
Desai et al.

(10) Patent No.: US 6,612,383 B2
(45) Date of Patent: Sep. 2, 2003

(54) METHOD AND APPARATUS FOR MILLING WELL CASING AND DRILLING FORMATION

(75) Inventors: Praful C. Desai, Kingwood, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/523,496

(22) Filed: Mar. 10, 2000

(65) Prior Publication Data

US 2001/0035302 A1 Nov. 1, 2001

Related U.S. Application Data

(63) Continuation of application No. 09/042,175, filed on Mar. 13, 1998, now abandoned.

(51) Int. Cl.[7] ..... E21B 29/06
(52) U.S. Cl. ..... 175/61; 175/426
(58) Field of Search ..... 175/61, 426, 431, 175/428, 379; 166/55.1, 296, 298, 50

(56) References Cited

U.S. PATENT DOCUMENTS

| | | | | | |
|---|---|---|---|---|---|
| 4,995,887 | A | | 2/1991 | Barr et al. | 51/295 |
| 5,025,874 | A | | 6/1991 | Barr et al. | 175/329 |
| 5,033,559 | A | * | 7/1991 | Fischer | 175/431 |
| RE33,751 | E | | 11/1991 | Geczy et al. | 175/61 |
| 5,070,748 | A | * | 12/1991 | Packer | 76/108.6 |
| 5,154,231 | A | | 10/1992 | Bailey et al. | 166/298 |
| 5,318,138 | A | | 6/1994 | Dewey et al. | 175/74 |
| 5,443,129 | A | | 8/1995 | Bailey et al. | 175/45 |
| 5,485,889 | A | | 1/1996 | Gray | 175/61 |
| 5,657,820 | A | | 8/1997 | Bailey et al. | 166/55.7 |
| 5,868,885 | A | * | 2/1999 | Crockett et al. | 156/89.27 |
| 5,887,655 | A | | 3/1999 | Haugen et al. | 166/298 |
| 5,887,668 | A | | 3/1999 | Haugen et al. | 175/79 |
| 5,979,571 | A | * | 11/1999 | Scott et al. | 175/61 |
| 5,979,579 | A | * | 11/1999 | Jurewicz | 175/428 X |
| 6,063,502 | A | * | 5/2000 | Sue et al. | 175/426 X |
| 6,131,675 | A | * | 10/2000 | Anderson | 175/268 |

FOREIGN PATENT DOCUMENTS

| | | | |
|---|---|---|---|
| GB | 2216929 A | | 10/1989 |
| GB | 2304760 A | | 3/1997 |
| WO | 0430590 | * | 6/1991 |
| WO | 98/13572 | | 4/1998 |
| WO | 98/34006 | | 8/1998 |

* cited by examiner

*Primary Examiner*—Heather Shackelford
*Assistant Examiner*—Sunil Singh

(57) ABSTRACT

A dual function drag bit is used in a method for both milling well casing or liner and subsequently drilling rock formation without the sequential removal of a milling assembly and replacement with a drilling assembly. The method employs a cutting tool that is capable of both milling steel pipe casing in a well bore and subsequently drilling rock formation outside the well bore after passing through the casing. In one embodiment an insert embedded into the surface of the cutting tool comprises at least an outer layer, such as cemented tungsten carbide, capable of milling steel casing, and at least a second layer, such as polycrystalline diamond, capable of drilling formation, the two layers being bonded together and to a carbide substrate. In another embodiment, inserts with a polycrystalline diamond cutting face for drilling rock formation are in parallel with cemented tungsten carbide cutters for milling steel casing.

6 Claims, 2 Drawing Sheets

METHOD AND APPARATUS FOR MILLING WELL CASING AND DRILLING FORMATION

CROSS-REFERENCE TO RELATED APPLICATIONS

This is a continuation application of U.S. patent application Ser. No. 09/042,175, filed Mar. 13, 1998 and entitled "Method for Milling Casing and Drilling Formation," now abandoned.

FIELD OF THE INVENTION

The present invention relates to a method for both milling well casing and/or liner and subsequently drilling rock formation without the sequential removal of a milling assembly and replacement with a drilling assembly.

BACKGROUND

When an existing cased oil well becomes unproductive, the well may be sidetracked in order to develop multiple production zones or redirect exploration away from the unproductive region. Generally, sidetracking involves the creation of a window in the well casing by milling the steel casing in an area either near the bottom or within a serviceable portion of the well. The milling operation is then followed by the directional drilling of rock formation through the newly formed casing window. Sidetracking enables the development of a new borehole directionally oriented toward productive hydrocarbon sites without moving the rig, platform superstructure, or other above ground hole boring equipment, and also takes advantage of a common portion of the existing casing and cementing in the original borehole.

Conventionally, sidetracking to develop a new borehole has required at least two separate steps, the first step requiring the milling of a window in the original well casing and the second step requiring the drilling of formation through the newly formed window to create the new borehole.

The first milling step is performed by either directly milling an entire elongated section of pipe casing or by milling through a particular area within the side of the casing with a mill guided by a directionally oriented ramp, or a whipstock. U.S. Pat. No. 4,266,621 describes a milling tool for elongating a laterally directed opening window in a well casing. The disclosed system requires three trips into the well, beginning with the creation of an initial window in the borehole casing, the extension of the initial window with a particular cutting tool, and the elongation and further extension of the window by employing an assembly with multiple mills.

By integrating a whipstock into the milling operation and directionally orienting the milling operation to a more confined area of well casing, the number of trips required to effectively mill a window in a well casing have been decreased. A whipstock having an acutely angled ramp is first anchored inside a well and properly oriented to direct a drill string in the appropriate direction. A second trip is required to actually begin milling operations. Newer methods integrate the whipstock with the milling assembly to provide a combination whipstock and staged sidetrack mill. The milling assembly is connected at its leading tool to the top portion of the whipstock by a bolt which, upon application of sufficient pressure, may be sheared off to free the milling assembly. The cutting tool employed to mill through the metal casing of the borehole has conventionally incorporated cutters which comprise at least one material layer, such as preformed or crushed tungsten carbide bonded to a carrier, designed to only mill pipe casing. The mills used for milling casing are not suitable for extensive drilling of rock formation.

Once a sufficient window has been created, the milling assembly is removed and the drilling assembly is inserted into the borehole and directed to the newly formed window to drill earthen formation. Directional drilling is achieved by a number of conventional methods, such as steerable systems, which, when used, control borehole deviation without requiring the drilling assembly to be withdrawn during operation.

A typical system may use a bottom hole motor with a bent housing having one fixed diameter bit stabilizer below the housing and one stabilizer above the housing in combination with a measurement-while-drilling (MWD) system. Deviation is achieved by using the motor output shaft to rotate the drill bit while avoiding rotation in the drill string, thereby taking advantage of the alignment offset between the drill bit and motor generated by the bent housing. Angular variations of as high as 3 to 8° per 100 feet (30 meters) are possible in such a system. Proper rotation of the drill string cancels angular deviations and can provide for an essentially straight drill path. Deviations, however, continue to occur at rates up to one degree per 30 meters as a result of variations in hole conditions, geological formations, and wear on the drill bit. Such variations can be corrected by steerable drilling assemblies.

Although drilling is often with a downhole motor operated at the end of a non-rotating drill string, one may also drill in a well borehole with a conventional rotating drill string.

The drilling of formation by the mill that cuts through the casing is limited in proximity to the creation of a "rat hole" near the existing borehole extending a distance of about five meters from the window through well casing. The milling assembly is fairly long and a rat hole is drilled into the formation to assure that the entire milling assembly passes through the casing and a complete window is made. A complete window is needed since the bits used for drilling rock formation are generally not considered suitable for milling casing. The rat hole is shorter than the bottom hole assembly used with the casing mill. Once the rat hole is complete, the milling cutter and bottom hole assembly is removed and followed by a third trip with a formation drilling assembly which then extends the borehole from the end of the rat hole to the next liner hanger point, the true end of the hole, or to an area proximate to the production zone being tapped.

Due to the high cost of oil well operations calculated both on a time and fixed cost basis, the current milling and drilling operations which require the insertion and removal of, at minimum, two separate tooling assemblies is inefficient and costly. Considerable time is lost round tripping tools in a well. A more cost effective approach to sidetracking would employ a method and incorporate the requisite devices which would both mill a window in the original well casing and subsequently drill formation through the newly created window in a single step.

It would be desirable to provide a method and device which enables the milling of pipe casing and subsequent drilling of formation without requiring multiple trips.

SUMMARY OF THE INVENTION

The present invention employs a dual-function cutting tool that is capable of milling pipe casing and/or liner and subsequently drilling formation. An exemplary cutter embedded in the cutting tool comprises at least a first material layer, such as cemented tungsten carbide, capable of milling pipe casing and/or liner and at least a second material layer, such as polycrystalline diamond, capable of drilling formation, the two layers being bonded together and to an insert body. The thickness and configurations of the material layers relative to each other and to the carrier vary and may include beveled and twin edge constructions which vary the cutting surface and improve the milling and drilling operation.

The cutting tool body is attached to a bottom hole assembly that connects to the drill string. The cutting tool may be optionally attachable to a whipstock to integrate the packing, anchoring, and orienting of a whipstock with the insertion of the milling and drilling assembly, thereby eliminating the need for a separate whipstock placement trip.

The milling and drilling process is conducted by shearing off the connection between the whipstock and cutting tool and directing the dual function milling and drilling assembly down the whipstock incline toward the well casing. After a window is milled through the casing, directional drilling can then proceed by any conventional method. The same cutting tool is used for both milling the casing and drilling the rock formation beyond the end of a traditional rat hole to the next liner hanger point or to the true end of the well.

Because the dual-function cutter eliminates the need to remove a milling assembly after creating a window in the pipe casing and subsequently send down a drilling assembly, the present invention provides a method which minimizes trips required to effectively sidetrack an existing borehole.

Other features and advantages of the present invention will become apparent from the detailed description in connection with the accompanying drawings.

DETAILED DESCRIPTION

Figure 1:
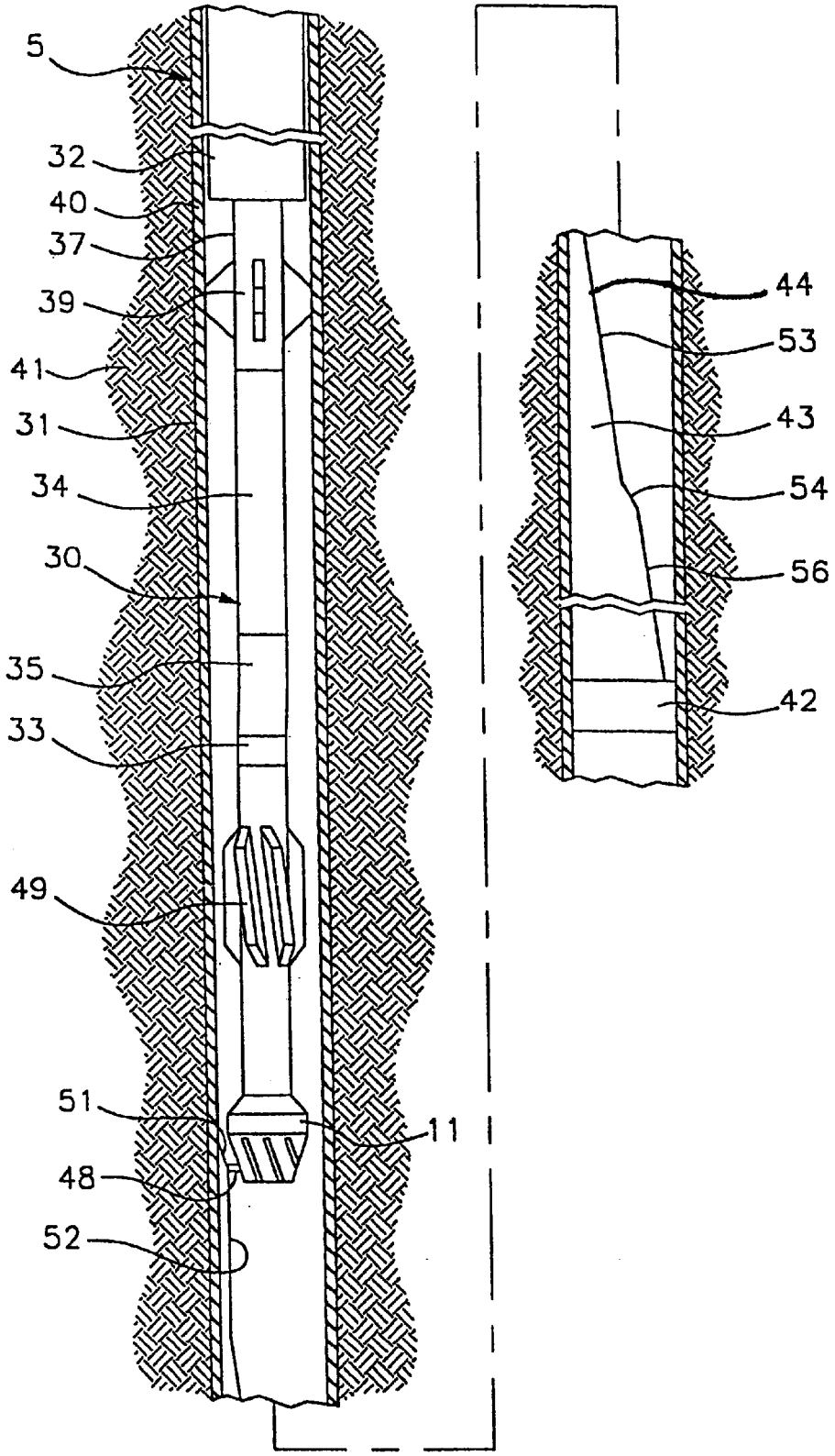
FIG. 1 is a view of a bottom hole assembly in a well with an anchor and deviation tool.

Referring now to the drawings, and more specifically to FIG. 1, the present invention comprises a method for both milling well casing and/or liner and subsequently drilling rock formation without the sequential removal of a milling assembly and replacement with a drilling assembly. Casing refers to steel pipe placed in well bore from approximately the ground surface. Liner refers to steel pipe placed in well bore and suspended from some level (referred to as a liner hanger point) below the ground surface. Typically, either casing or liner is cemented in the well bore with a cement grout. Since both are steel pipe and it makes no difference for practice of this invention where the pipe is suspended, the pipe is referred to herein simply as casing.

A preferred embodiment of an apparatus capable of practicing the method of the present invention is shown in FIG. 1. A bottom hole assembly 30 with a cutting tool 11 which has the capability of both milling well pipe casing 40 and drilling earthen formation 41 includes a series of tools 32–39 between the cutting tool 11 and the drill pipe 31, described in greater detail hereinafter.

Unlike conventional cutting tools, the cutting tool 11 employed in the present invention is multi functional in that it is designed to both mill pipe casing 40 and subsequently drill earthen formation 41. While the present invention is not limited to any particular design for a multi functional cutting tool capable of sequentially milling pipe casing and drilling formation, an exemplary embodiment of the cutting tool 11 is provided in FIG. 2.

Figure 2:
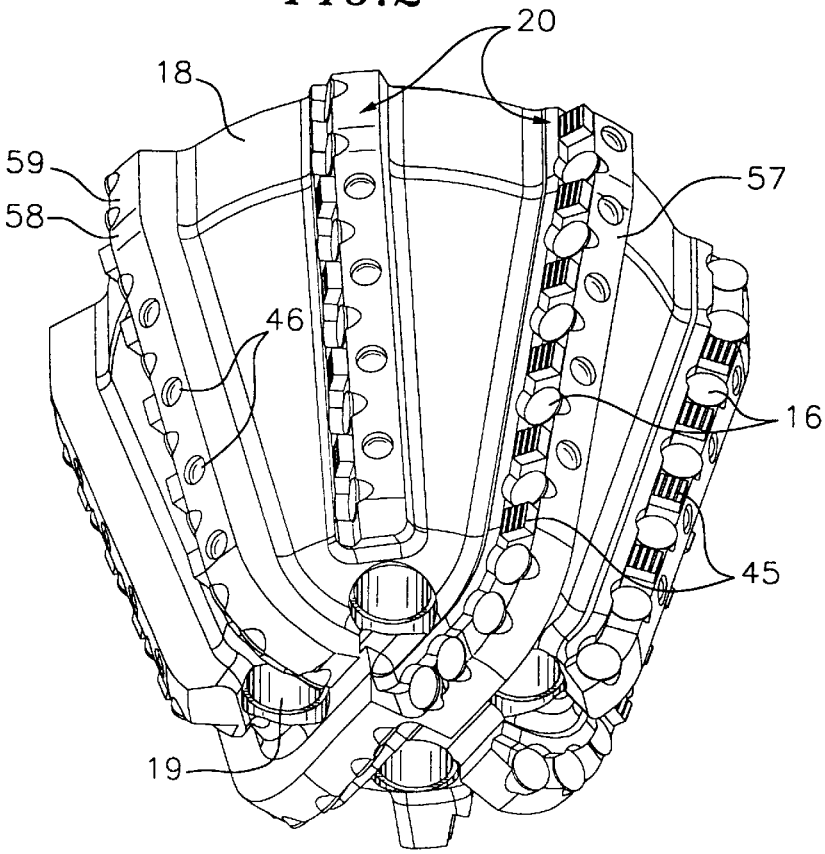
FIG. 2 is a perspective view of an exemplary cutting tool for use in the present invention.

In the embodiment shown in FIG. 2, the cutting tool 11, of a form commonly referred to as a drag bit, comprises a body 18 with a threaded shank at the top (hidden in this view) for connection to a bottom hole assembly 30. The body 18 may be formed from steel or a tungsten carbide matrix infiltrated with a binder alloy or any other material used in the art. Extending outwardly from the base of the cutting tool body 18 are a series of arched projections or blades 20 which comprise the cutting tool surface and into which are embedded inserts or cutters 16. Within the cutting tool body 18 are one or more passages ending in openings 19 through which drilling fluid may be delivered to cool the cutting tool surface and remove accumulated debris.

In the illustrated embodiment, the inserts 16 comprise 13 mm diameter cylindrical bodies of cemented tungsten carbide with a layer of polycrystalline diamond (PCD) on an end face. Each insert is press fitted into a hole in the respective blade. The exposed faces of the inserts are cutting surfaces of the drag bit. The PCD layers on the inserts may be the only cutting elements employed in a bit, or as in the illustrated embodiment, additional milling cutters may also be employed.

A cemented tungsten carbide rectangular or oval cutter 45 is brazed to the face of each blade at a location intermediate between at least some of the PCD inserts. An exemplary cutter is a steel cutting grade of cemented tungsten carbide about 9.5 mm square and about 4.75 mm thick. Typically the cutting face plane of a carbide cutter leads (in the direction of rotation of the bit) the cutting face plane of the adjacent PCD inserts by about four to five millimeters. In effect, the carbide cutters are in parallel with the PCD layers on the inserts rather than being in series with the PCD as in the embodiment illustrated in FIG. 3.

As explained in greater detail hereinafter, when the bit is used in an oil well or the like, the carbide cutters first mill a window through steel casing in the well. After the window is cut, the bit operates in the surrounding rock formation. The carbide cutters are not as durable for cutting rock formation and are eroded away, leaving the PCD faces on the cylindrical inserts to cut rock formation as the bit is used for further drilling of the well. The milling cutters mounted between the PCD inserts may have different rake angles from the PCD inserts. Thus, for example, the carbide cutters may have a rake angle optimum for cutting steel and producing chips that can be readily pumped from the well, whereas the PCD inserts are placed with a rake angle better suited for drilling rock formation.

Cemented tungsten carbide buttons 46, which may have a layer of PCD on the exposed face, are inserted into the outer faces of the blades for wear protection of the blades as they rub against steel casing and rock formation. The wear buttons help maintain gage of the cutting tool and borehole.

As an alternative to providing separate pieces of cemented tungsten carbide on the face of the blades for cutting steel, carbide can be provided on the face of some or all of the PCD inserts. Such a layer of carbide can be used for milling steel casing, and after the bit enters rock formation, the carbide is eroded away leaving the PCD layer exposed for drilling rock formation.

Figure 3:
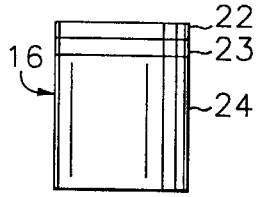
FIG. 3 is a side view of an exemplary cutter for use in the present invention.

As shown in FIG. 3, such an insert 16 comprises material layers 22, 23 which are bonded onto a carrier substrate 24 and then secured into the cutting surface of the cutting tool. As stated previously, the material layers have conventionally been designed to be mono-functional. The present invention uses a first material layer 22 which is capable of milling pipe casing, such as 9⅝ inch steel casing, bonded to a second material layer 23 which is capable of drilling earthen formation. The type of metal used in the pipe casing and the type of geological formation being drilled determine the materials to constitute the first or outer layer 22 and second material layer 23.

Materials such as polycrystalline diamond, polycrystalline cubic boron nitride (PCBN), natural diamond, titanium nitride, tungsten carbide or tungsten carbide cemented with cobalt can be used in either the first layer 22 or second material layer 23, as suitable for the intended functions of milling steel casing or drilling rock formation, respectively. It is within the knowledge of one skilled in the art to choose the proper combination of material layers based upon the type of casing and geological formations being encountered.

If milling a 9⅝ inch steel casing, a preferred embodiment of the present invention employs a first material layer 22 made of cemented tungsten carbide bonded to a second material layer 23 made of polycrystalline diamond. PCBN can be used in the first material layer 22 but, relative to a milling grade of tungsten carbide, it does not mill steel as effectively. Both tungsten carbide and PCBN are preferred materials for the first material layer 22 over PCD because, unlike PCD, they do not react with iron.

Preferably, the second layer is formed of PCD which is found to drill rock formations effectively. Additionally, natural diamond may be employed when certain geological formations, such as sandstone, are expected to be encountered. Thus, a preferred insert for a bit for both milling casing and drilling rock formation comprises a body of cemented tungsten carbide 24, usually of a tough grade for mounting in the bit body. A layer of PCD 23 is formed on an end face of the body and a layer of steel cutting grade cemented tungsten carbide 22 is formed over the PCD.

Such an insert is formed by placing a layer of diamond particles, possibly mixed with cobalt powder, adjacent to a body of cemented tungsten carbide. A layer of tungsten carbide powder and cobalt powder (or a cobalt foil layer and layer of carbide particles) is placed over the diamond layer. This assembly is placed in a refractory metal "can" and a pressure transmitting medium, and processed in a high pressure, high temperature press at a temperature and pressure where diamond is thermodynamically stable. This forms an integral insert with a carbide body, PCD layer and carbide layer.

Figure 4:
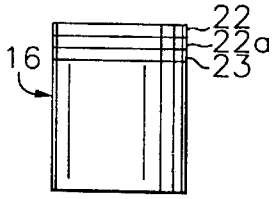
FIG. 4 is a side view of a second embodiment of exemplary cutter.

Optionally, as shown in FIG. 4, an intermediate layer 22*a* juxtaposed between the first material layer 22 and second material layer 23 can be used for brazing a preformed layer of cemented tungsten carbide on a layer of PCD. Additionally, chip breakers (not shown) may be used to enable the breaking off of top chip layers to increase the effectiveness of the milling and drilling process. A plurality of material layers may be used in the insert 16 of the present invention without exceeding the scope of the invention, provided the material layers enable the sequential milling of pipe casing and drilling of earthen formation.

Figure 5:
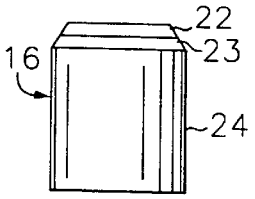
FIG. 5 is a side view of a beveled cutter.
Figure 6:
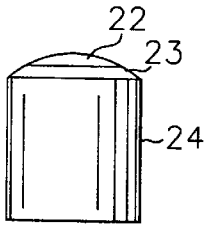
FIG. 6 is a side view of a cutter with a rounded profile for use in the present invention.

The placement of each material layer 22, 23 relative to each other and to the insert body 24 can take numerous configurations and is dependent and determined by the expected wear profile. One preferred embodiment, shown in FIG. 5, employs a beveled structure where the first layer 22 substantially covers the second layer 23 and both material layers 22, 23 cover the face of the insert body. The beveled edge has an angle corresponding to the rake angle of the insert mounted in the bit body. This may improve the performance of the insert and minimize chipping. For directional drilling, a rounded insert profile, shown in FIG. 6 can be used to attain sufficient side loading. Different geometries of insert may be used in the gage rows and in inner rows on the cutting tool.

The cutting tool 11 is used in conjunction with a bottom hole assembly 30 which stabilizes the cutting tool, provides the motive force for rotating the cutting tool, and after milling through casing, directionally controls the movement of the cutting tool in rock formation. While components of the bottom hole assembly may be varied without exceeding the scope of the claimed invention, the bottom hole assembly is described in relation to an exemplary embodiment illustrated semi-schematically in FIG. 1. It will be recognized that the relative lengths and diameters of the parts of the bottom hole assembly may be rather different from what is illustrated.

The bottom hole assembly 30 comprises drill collars 32, a rotatable shaft 33, a bottom-hole motor output shaft (not shown), bottom-hole motor 34, a bent housing 35, one or more stabilizers 39 and a connector sub 37. The cutting assembly includes cutting tool 11 for milling casing and drilling rock formation as provided in practice of this invention, and a second milling tool 49 above the cutting tool. The cutting tool 11 opens a window through the casing in a well and the second milling tool enlarges and cleans up the shape of the window. A third milling tool may also be used if desired. The second and third milling tools are conventional watermelon mills or window mills.

The cutting assembly connects to the bottom hole assembly 30 by connecting to the rotatable shaft 33 which, in turn, is connected to the output shaft (not shown) of the bottom-hole motor 34 through a bent housing 35. The housing of the bottom-hole motor connects to the sub 37. Three or more stabilizers 39 are typically spaced along or above the bottom hole assembly to keep portions centralized in the borehole. The stabilizers commonly employed are cylindrical tubes treated with hard facing material, such as tungsten carbide, with projections or blades welded onto or machined integral with the cylindrical body. The drill collars 32, heavy pieces of pipe with small internal diameters, are fitted along the drill string to impress weight on the cutting tool.

The bottom hole assembly may be guided to the area of well casing where penetration is desired through any method currently used in the art. One approach is to introduce a packer 42 into the existing well 5 followed by a drill guiding tool, such as a whipstock 43, which deflects the bottom hole assembly toward the side of the well and onto the pipe casing 40. Having a ramped surface 44 with an inclination toward the borehole wall, the whipstock 43 substantially acts as a bearing surface for laterally forcing the bottom hole assembly 30, particularly the cutting tool 11, into the pipe casing 40. The whipstock 43 is preferably made of a material, such as steel, which is not easily worn or destroyed by the action of a cutting tool rotating downward along the whipstock and impacting the surface 44 thereof.

Preferably, the deviation of the bottom hole assembly would employ an approach which minimizes the number of trips required for the entire milling and drilling operation. One such device and method is disclosed in U.S. Pat. Nos. 5,154,231 and 5,455,222. An anchor is hydraulically set in the well 5 and is connected to the lower end of a tool which connects to the surface of the whipstock 43. Positioning dogs are employed between the anchor and whipstock to position the whipstock at the appropriate angular position within the well.

The bottom hole assembly can be connected to the whipstock to both facilitate positioning and eliminate the requirement of separate trips for positioning the whipstock and initiating milling and drilling operations. The cutting tool 11 may be connected to the top portion of the whipstock by a bolt 48 which, upon application of sufficient pressure, is sheared off, thereby releasing the bottom hole assembly from its fixed position relative to the whipstock and permitting it to proceed down a path toward the pipe casing defined by the inclination of the face of the whipstock. The connection between the bit and the whipstock may be hollow and/or connected via a port through the body of the bit so that upon shearing off of the connection, the port is opened and serves as a fluid port during the milling and drilling operation.

The drag bit for milling casing and drilling adjacent rock formation after a window is cut through the casing, is preferably used with a whipstock having complementary surfaces, as described in U.S. patent application Ser. No. 08/642,829, now U.S. Pat. No. 5,771,972, assigned to the same assignee as this application. The subject matter of the pending application is hereby incorporated by reference.

In a typical embodiment, the whipstock has a ramp surface with several different angles relative to the axis of the borehole in which it is placed. At the upper end of the whipstock there is a short surface 51 having an angle of about 15° which is useful for starting the cutting of a window. Just below the starting ramp 51, there is an elongated surface 52, which is parallel to the axis of the hole. The length of the parallel surface is about the same as the distance between the first cutting tool 11 and the second milling tool 49. Next, going down the borehole, there is a ramp surface 53 on the whipstock with an angle of about 3° from the borehole axis. The 3° surface continues until it reaches approximately the centerline of the borehole. At that elevation there is a short 15° "kickoff" surface 54. Below the kickoff surface the face of the whipstock reverts to a 3° angle.

The cutting tool 11 used for milling casing and subsequently drilling rock formation, has complementary angles on the blades 20 and inserts in the blades. At least a portion of the blades adjacent to the bottom end of the cutting tool or bit, extend approximately to the centerline of the bit so that inserts mounted adjacent to the center may mill the steel pipe and drill rock formation. The principal length of the tool for milling and drilling defines a conical surface 57 having an included half angle of 15° (i.e., complementary to the 15° angles at the upper end of the whipstock, and on the kickoff face). Next (going in the up-hole direction) there is a shorter portion 58 having an angle of 3° relative to the axis of the tool. Finally, near the upper end of the cutting tool, there is a portion 59 parallel to the axis and having a diameter or gage corresponding to the gage of the sidetrack hole to be formed in the rock formation.

As the assembly for milling a window in steel casing and drilling adjacent rock is used, the 15° portion of the cutting tool engages the 15° starting surface on the whipstock. This forces the rotating cutting tool laterally into the steel of the casing to commence milling the casing. This also brings the second "watermelon" mill 49 against the casing to mill an upper portion of a window through the casing above the whipstock. The relative areas of the portion of the cutting tool engaging the whipstock and casing, are preferably arranged so that the cutting tool primarily mills casing without greatly damaging the surfaces of the whipstock (whipstocks are conventionally made with materials that are more resistant to milling than are steel casings encountered in oil wells).

After the cutting tool has penetrated the casing, the tool passes to the portion 52 of the whipstock that has a surface parallel to the axis of the borehole. Thus, the cutting tool progresses downwardly, milling casing without progressing further into the cement and rock formation surrounding the casing. This continues to permit the watermelon mill to reach the level where the first cutting tool penetrated the casing. Thereafter, the 3° portion of the cutting tool engages the 3° ramp surface 53 on the whipstock, and is further forced laterally into the casing and surrounding cement; gradually enlarging both the length and width of the window through the casing. The watermelon mill follows, cleaning up the window made by the cutting tool.

As the center of the cutting tool approaches a point where it should be milling casing, the 15° portion of the cutting tool engages the kickoff surface 54. This tends to force the cutting tool laterally through the casing and surrounding cement at a relatively rapid rate through the portion of the milling operation where the center of the cutting tool is cutting the steel of the casing. This is a part of the milling operation where the rate of penetration is relatively lower and is desired to proceed through this part rapidly.

After the center of the dual function cutting tool has passed through the casing, the cutting tool engages the final 3° ramp 56 on the whipstock and proceeds to enlarge the window through the casing and extend further into the rock formation. Meanwhile, the second milling tool 49 continues to enlarge and clean up the window through the casing.

Typically, in the past, the sidetracking operation has continued after the initial milling tool has passed through the casing to produce a short rat hole in the formation adjacent to the original borehole, which has sufficient length to accommodate at least the second (and third if used) milling tools, and usually a small additional portion of the bottom hole assembly. The prudent driller typically makes the rat hole deep enough to assure that the subsequent drill bit will pass cleanly through the window. A typical rat hole is four or five meters deep and is not drilled deep enough to accept the entire bottom hole assembly.

The bottom hole assembly embodiment of FIG. 1 permits the exertion of directional control over the milling and drilling process. As discussed in Reissue Pat No. 33,751, the offset of the cutting tool from center, created by the bend angle of the bent housing 35 located between the cutting tool and bottom-hole motor, enables the exertion of control over the angular orientation of the cutting tool within the formation and, therefore, the direction of drilling. The magnitude and vector orientation of the cutting tool are further affected by the size and location of stabilizers and the weight on the cutting tool. It is within the knowledge of one skilled in the art to properly determine the aforementioned variables in order to achieve a desired direction for drilling.

The operation of the present invention is unique in that it eliminates separate trips down the well for the purpose of milling pipe casing and drilling formation. The bottom hole assembly is inserted into the well in connection with a whipstock which is hydraulically anchored within the well. The connection between the bottom hole assembly and whipstock, often located proximate to the cutting tool in the form of a bolt 48, is severed upon application of sufficient force, permitting the bottom hole assembly to be directed toward the pipe casing by the bearing surfaces of the whipstock.

Once the milling process is complete and a sufficient window is formed, the dual-purpose cutting tool, directed by the bottom hole assembly, continues through the window and forms a rat hole extending from the well and into surrounding formation 41, defined in distance from the well at about five meters from the bottom of the window. In a conventional milling operation, the casing mill is run into the rat hole about five meters. A typical casing mill has two or three milling cutters and by drilling a rat hole five meters beyond the window, the driller is certain that the elongated window is full size completely through the steel casing and the last of the milling cutters has cleared the casing. The milling tool is then withdrawn from the well. Traditionally, this occurs before the entire bottom hole assembly has passed through the window in the casing. By that time, the whipstock has essentially no further directional influence on the direction of drilling by the cutting tool.

Further cutting of the rock formation outside the casing is usually undesirable since the conventional casing mill is designed specifically for cutting casing and is not particularly well suited for drilling formation. Certainly the milling tool would not be run into the formation more than fifteen meters beyond the bottom of the window, far beyond the usual depth of the rat hole. The casing mill wears rapidly in the rock formation and is not suitable for drilling to the next liner hanger point or true bottom of the well. At the point where a rat hole has been formed, a conventional casing mill would be withdrawn from the borehole and a conventional drill bit run in for drilling rock formation outside the casing. The conventional drill bit is not particularly well suited for milling casing and would, typically, have unacceptable wear when so used.

In practice of this invention, however, the same drag bit is used for milling through the casing and for drilling rock formation to the next liner hanger point, for example. This is typically more than fifteen meters beyond the sidetracked well bore, much further than a traditional rat hole. As the dual-function bit drills further into the formation the downhole motor and bent housing assembly are used for steering to provide directional control of the borehole being drilled. Alternatively, steering may be provided by way of a steerable bottom hole assembly on a rotating drill string.

In an embodiment with inserts as described and illustrated in FIG. 3 are employed, when the inserts 16 have had the outer material layer designed to mill the pipe casing worn away, the second material layer 23 designed to drill formation is exposed. The drilling of rock formation continues due to the rotary application of the combined milling and drilling tool to formation for a desired distance beyond the length of a conventional rat hole. The drilling of formation can continue without requiring the removal and/or replacement of the drilling assembly until the next liner hanger point is reached by the cutting tool or until the cutting tool reaches the true end of the newly sidetracked well.

A presently preferred embodiment of dual function insert has an outer layer of cemented tungsten carbide since this material is particularly well suited for milling steel. The second layer is preferably PCD since this material is particularly well suited for drilling a variety of rock formations. The thickness of the layer of carbide on the PCD layer is sufficient to assure that the dual function bit has milled completely through the casing. This is typically about ¾ millimeter, but thinner layers may be suitable when thinner wall casing is being milled. Preferably, the thickness of carbide is not much more than ¾ millimeter since wear of the carbide from the diamond can change the geometry of the insert so much that the bit geometry and gage may be adversely affected.

Another embodiment has an outer layer of PCD having a relatively larger average crystallite size, for example about 40 micrometers. This overlies another layer of PCD having a relatively smaller average crystallite size, for example, 30 micrometers or less. A coarser grain size PCD may be suitable for milling steel at a relatively low rotational speed where the diamond is not overheated. The finer grain size PCD is better suited for drilling rock formation. The diamond grain sizes in the two layers may blend together without a sharp change in grain size.

It is also found that coarse grain PCD may be used for both milling casing and drilling rock formation when not overloaded or overheated. A drag bit with PCD faced inserts, wherein the diamond has an average crystallite grain size of about 40 microns has been found suitable for milling casing and continuing to drill rock formation far beyond the traditional depth of a rat hole. Typical thickness of PCD on an insert is in the order of ¾ millimeter.

Alternatively, a bit having PCD inserts and cemented tungsten carbide cutters may be used, in which case the cutters wear away in the rock formation and the PCD inserts take over the drilling operation.

In an exemplary sidetracking operation, a window may be cut in a 9⅝ inch casing and about 100 meters of hole drilled with an 8½ inch drilling bit. A 7½ inch liner is then cemented in the sidetracked hole, and a 4½ inch bit used to drill further into the formation. Traditionally, two bits are used for milling the casing and drilling the 100 meter extension. With this invention, a single dual function drag type bit with PCD inserts may be used for both milling a window through the casing and extending the hole 100 meters or more through the formation for placement of a liner.

In another embodiment, a layer of PCD may be formed on a carbide body. This is covered with a layer of titanium nitride or titanium carbonitride which is used as the material for milling the steel casing.

Figure 7:
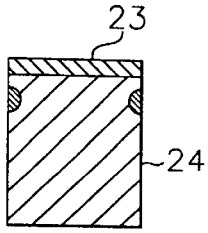
FIG. 7 is a longitudinal cross section of another embodiment of cutter.

Still another embodiment of insert, as illustrated in FIG. 7, has what amounts to two cutting edges. A carbide body 24 has a layer 23 of PCD on an end face. A layer of carbide may be formed or brazed over the PCD if desired, or the diamond layer may be used for milling the steel casing. In this embodiment there is also a ring or band of PCD formed in a circumferential groove around the cemented tungsten carbide body. As this embodiment of insert is used, the layer of PCD on the front face may wear and the additional band of PCD then serves as a second cutting edge. If desired, the edges of the insert may be beveled at the rake angle so that the second cutting edge is exposed at the beginning of drilling.

The inserts described and illustrated herein have each featured a cylindrical cemented tungsten carbide body with layers of material for milling casing and drilling rock formation on one end face. It will be apparent to those familiar with drag bits that other types of inserts may be employed. For example, one popular type of PCD insert has a disk-like carbide substrate with a layer of PCD formed on one face. This disk of carbide is brazed at an angle to a carbide stud which is inserted in a hole in the bit body. Other geometries of inserts may also be employed.

The present invention is not specifically limited to any particular type of borehole and can be employed in wells including but not limited to wildcat, test, out-post, development, exploration, injection and production wells for oil, gas or geothermal energy. Furthermore, while the invention is described in connection with preferred embodiments, the present invention is not limited to those embodiments and should be considered to include all equivalents that may be included within the scope of the invention as defined by the claims.

What is claimed is:

1. A method of drilling a portion of a well comprising the steps of:

introducing a dual function tool into a well bore;

milling a window in a steel casing in the well bore with the dual function tool, including drilling a rat hole in a formation adjacent to the well bore, said tool comprising:

a tool body, a plurality of blades on the tool body with radially and longitudinally extending slots between the blades, and a plurality of inserts mounted in the blades, each of the inserts comprising an insert body, and a layer of steel cuffing grade polycrystalline diamond material on a cutting face of each insert body for milling a window through the steel casing and for drilling the formation adjacent to the well bore.

2. The method for drilling a portion of a well bore in claim 1 further comprising the steps of:

continuing drilling the formation beyond the end of the rathole with the same tool.

3. The method for drilling a portion of a well bore in claim 1 further comprising the steps of:

continuing drilling the formation with the same tool beyond a location where a whipstock has an influence on the direction of the drilling.

4. The method for drilling a portion of a well bore in claim 1 further comprising the steps of:

continuing drilling the formation adjacent to the well bore with the same tool; and thereafter steering the tool for directional drilling control in the formation.

5. The method for drilling a portion of a well bore in claim 4 wherein said steering is provided by a rotary steerable bottom hole assembly.

6. The method for drilling a portion of a well bore in claim 4 wherein said steering is provided by a down hole motor and bent housing assembly.

* * * * *